US005195828A

United States Patent [19]

Bush-Rodriquez

[11] Patent Number: 5,195,828

[45] Date of Patent: Mar. 23, 1993

[54] COMBINATION GROUND COVER AND TOTE BAG

[76] Inventor: Jeffrey Bush-Rodriquez, P.O. Box 18749, Raleigh, N.C. 27619

[21] Appl. No.: 851,064

[22] Filed: Mar. 13, 1992

[51] Int. Cl.[5] ..... B65D 33/28

[52] U.S. Cl. ..... 383/4; 383/76; 190/2; 5/417

[58] Field of Search ..... 383/4, 76; 190/2; 5/417

[56] References Cited

U.S. PATENT DOCUMENTS

| | | | |
|---|---|---|---|
| 2,479,203 | 8/1949 | Brown | 383/4 |
| 2,731,997 | 1/1956 | Muth et al. | 383/4 |
| 4,337,812 | 7/1982 | Trinkner | 383/4 |
| 4,709,430 | 12/1987 | Nicoll | 383/4 X |
| 4,789,247 | 12/1988 | Schnoor | 383/76 X |
| 4,856,912 | 8/1989 | Damus et al. | 33/270 X |
| 4,991,978 | 2/1991 | Ostrowski | 383/76 X |
| 5,092,681 | 3/1992 | Ashley, III | 383/4 |

*Primary Examiner*—Allan N. Shoap
*Assistant Examiner*—Jes F. Pascua
*Attorney, Agent, or Firm*—Rhodes, Coats & Bennett

[57] ABSTRACT

The present invention entails a convertible cover-tote apparatus that is positionable between a ground covering position and a tote or carrying position. The cover-tote apparatus includes a cover or blanket that is formed from a sheet of nylon, polycotton, cotton or other synthetic fabric. The cover has a plurality of eyelets fixed to the cover at a position approximately midway between the cover's center and outer border. A drawstring is interweaved through the eyelets and encircles the center of the cover at a location approximately midway between the cover's center and outer border. The drawstring defines the border between a center and outer section of the cover. In the ground covering position, the cover is extended over a surface that a user can sit or lie thereon. The cover-tote apparatus is positionable from the covering position to the tote position by drawing the eyelets together with the drawstring. When in the tote position, the cover-tote apparatus includes a bag formed from the center section of the cover and a skirt formed from the outer section of the cover. The bag is used to carry articles such as towels, books, and other articles typically used during activities requiring a ground cover. The skirt extends over the bag and protects the user from soil, dirt, or moisture that may have adhered to the underside of the cover while the cover was in the ground covering position. In addition, the formation of a skirt limits the size of the bag and results in the cover-tote apparatus having a more manageable tote position.

7 Claims, 2 Drawing Sheets

COMBINATION GROUND COVER AND TOTE BAG

FIELD OF THE INVENTION

The present invention relates generally to ground covers for accommodating a person sitting or lying thereon and to carrying bags, and more particularly, to an article that is convertible between a ground cover for accommodating a person sitting or lying thereon and a tote or carrying bag.

BACKGROUND OF THE INVENTION

Ground covers and tote bags are two articles typically needed for activities such as picnicking and suntanning. People engaging in these activities spread covers over a ground surface so that they can sit or lie on the ground without contacting or being soiled by the underlying dirt or sand. Various articles such as towels, books, suntan lotion, and food are used when engaging in these activities and a bag or tote is helpful in carrying these articles.

There are several designs of articles which alternatively function as a ground cover or a carrying bag. For examples of prior art cover-tote apparatuses, please refer to the following patents: U.S. Pat. No. 4,794,029, issued Dec. 27, 1988; U.S. Pat. No. 4,991,978, issued Feb. 12, 1991; U.S. Pat. No. 4,337,812, issued Jul. 6, 1982; U.S. Pat. No. 4,789,247, issued Dec. 6, 1988; and U.S. Pat. No. 4,738,545, issued Apr. 19, 1988. These prior art cover-tote apparatuses allow a user to use one apparatus as a ground cover for sitting or lying thereon and also as a bag for carrying articles.

In general, the cover-tote apparatuses of the prior art are constructed from a sheet of pliable fabric that forms a ground cover. The covers may have a variety of shapes but are typically rectangular or circular. Extending along the outer border of the covers is a drawstring. The cover and attached drawstring form a cover-tote apparatus that is positionable between a ground covering position and a tote position for carrying articles to and from the area where the ground cover is needed.

To place a cover-tote apparatus in a ground covering position, a user spreads open the cover and lays one side of the cover against the ground surface. The underside of the cover lays adjacent to the ground surface and the upperside of the cover lays adjacent to the user sitting or lying thereon. The underside of the cover is likely to become soiled or sandy from contacting the underlying ground, while the upper side of the cover only contacts the user and thus remains relatively clean.

The cover-tote apparatus, after use as a ground cover, converts into a carrying bag by using the drawstring to draw the outer borders of the cover together such that a bag with a string handle is formed. The upperside of the cover forms the interior side of the bag, while the underside of the cover forms the exterior side of the bag.

One disadvantage of the prior art cover-tote apparatuses is that a cover used to overlay a relatively large surface area will result in a carrying bag that is unduly large and cumbersome for the user to carry.

Another problem with the prior art cover-tote apparatuses is that the exterior side of the carrying bag normally becomes soiled when the cover-tote apparatus is used as a ground cover and this soiled side of the bag will undesireably rub against the user carrying the bag. The exterior side of the carrying bag is normally soiled because of the dual function of the cover-tote apparatus. One side of the cover-tote apparatus alternatively acts as the underside of the cover when the cover-tote apparatus is in a covering position and as the exterior side of the carrying bag when the cover-tote apparatus is in a tote position. When in the covering position, the underside of the cover becomes unavoidably soiled from the adjacent ground surface. This soiled side of the cover becomes the exterior side of the carrying bag when the cover is converted from the ground covering position to the tote position. The soiled, exterior side of the carrying bag undesireably rubs against the user carrying the bag, causing any soil on the cover to be rubbed against the person.

Another problem with the prior art cover-tote apparatuses is that sand or soil spread onto portions of the upper side of the cover will fall into the bag section when the cover-tote apparatus is placed into the tote position.

SUMMARY AND OBJECTS OF THE INVENTION

The cover-tote apparatus of the present invention effectively solves the above-discussed limitations of the prior art cover-tote apparatuses. The cover-tote apparatus of the present invention includes a cover formed from a circular sheet of fabric that is of a size sufficient to accommodate a user sitting or lying thereon. Encircling a center section of the cover are a plurality of eyelets and an endless drawstring interweaved through the eyelets. The eyelets and interweaved drawstring are located substantially inward from the outer border of the cover and define a border between a center section and an outer section of the cover. In the preferred embodiment, the location of the encircling eyelets and interweaved drawstring is approximately midway between the center and outer border of the cover.

When in a ground covering position, the cover lies flat against a ground surface such that the underside of the cover lies adjacent to the ground surface and the upperside of the cover lies adjacent to a user sitting or laying on the cover. After use as a ground cover, the user pulls the drawstring upwardly causing the cover's section to convert into a bag and the cover's outer section to convert into a skirt that extends downwardly over the bag.

An upperside portion of the cover forms the interior of the carrying bag, while an underside portion of the cover forms the exterior of the carrying bag. Therefore, as with the prior art cover-tote apparatuses, the exterior side of the carrying bag will be soiled from previously functioning as the underside of the ground cover. However, in the present invention cover-tote apparatus a skirt is formed from the outer section of the cover, and extends downwardly over the soiled exterior side of the bag.

The skirt folds downwardly over the bag such that the side of the skirt that previously functioned as an underside portion of the cover is positioned adjacent to the exterior of the bag. The side of the skirt that functioned as an upperside portion of the cover, and that is relatively clean, is thus located between the user carrying the bag and the bag. Therefore, the skirt acts to protect the user from the underside of the cover that is soiled from being placed adjacent to the ground surface.

In addition, the skirt limits the amount of sand that falls into the bag. Sand that has fallen onto the upper section of the skirt falls off the cover-tote apparatus and limits the amount of sand that falls into the bag. The skirt also limits the size of the bag formed by the cover-tote apparatus and allows for easier manageability of the cover-tote apparatus while it is in a tote position.

Accordingly, an object of the present invention is to provide a cover-tote apparatus that is quickly and conveniently converted between a covering position and a tote position.

Another object of the present invention is to provide a tote-cover apparatus that covers a large ground surface while in a ground covering position and is convertible to a bag of manageable size.

Another object of the present invention is to provide a means for limiting amount of sand or soil located on the upper side of the cover deposited into the bag section of the cover-tote apparatus when the apparatus is placed from the ground covering position to the tote position.

Another object of the present invention is to protect a user carrying the tote bag from soil, dirt, or moisture that may have adhered to the underside of the cover-tote apparatus while the cover-tote apparatus was positioned against a ground surface.

Other objects and advantages of the present invention will become apparent and obvious from a study of the following description and the accompanying drawings which are merely illustrative of such invention.

DETAILED DESCRIPTION OF THE INVENTION

Figure 1:
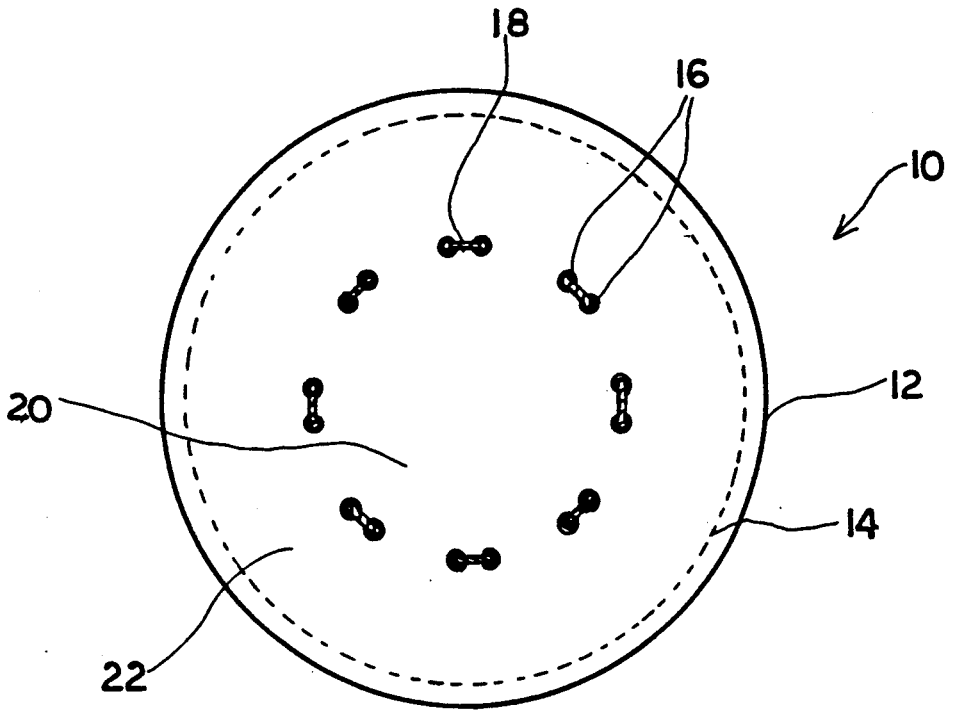
FIG. 1 is a top plan view of the cover-tote apparatus of the present invention.

Referring to the drawings, the present invention is a cover-tote apparatus indicated generally by the numeral 10. Cover-tote apparatus 10 is positionable between a covering position shown in FIG. 1 and a tote position shown in FIG. 3. Cover-tote apparatus 10 includes a cover or blanket 12, eight pairs of eyelets 16 which are attached to cover 12, and an endless drawstring 18 interweaved through eyelets 16.

Cover 12 is constructed from a pliable sheet of fabric made of a nylon, polycotton, cotton, or other synthetic material. Cover 12 is of a size sufficient to accommodate a person sitting or lying on the cover when the cover-tote apparatus 10 is in the covering position. As shown in FIG. 1, when cover-tote apparatus 10 is in the open position cover 12 has a circular shape with a center point 12*a* and an outer edge 12*b*. In the preferred embodiment, cover 12 has a diameter of approximately seven feet, but alternative embodiments having other dimensions and shapes (i.e., rectangular, square, etc.) may also be designed.

A binding or weighted cord weighted element, such as a 14, which is sewn into the edge of cover 12 forms the outer border of cover 12. Binding 14 may additionally be weighted with a cord or an additional fabric that extends along the outer border of cover 12 and helps maintain cover 12 in a circular shape when cover-tote apparatus is placed in a covering position.

Pairs of eyelets 16 are attached to cover 12 such that the eyelets 16 provide a series of openings through cover 12. The eyelet openings extending through cover 12 are of a size sufficient for drawstring 18 to be threaded therethrough, and provide a means for attaching drawstring 18 about cover 12. Eyelets 16 are designed to be resistant to corrosion in order to withstand exposure to water, salt, and sand. Likewise, eyelets 16 are designed to conduct heat poorly in order to account for user contact with eyelets 16. The thickness of eyelets 16 is equivalent or only slightly greater than the thickness of cover 12. In the preferred embodiment, eyelets 16 are constructed from plastic, brass, or have a nickel-coated construction.

Drawstring 18 interweaves through the pairs of eyelets 16 and along both sides of cover 12. In the preferred embodiment, drawstring 18 is made of nylon and has a diameter of approximately one-eigth to one-half of an inch. As shown in FIG. 1, pairs of eyelets 16 and interweaving drawstring 18 encircle cover 12 at approximately midway between the center and outer border of cover 12. Eyelets 16 and drawstring 18 partition cover 12 into a center section 20 and an outer section 22. Eyelets 16 and drawstring 18 are located at the intersection of center section 20 and outer section 22. Center section 20 extends from eyelets 16 and interweaving drawstring 18, which are located at the outer border of center section 20, to the center of cover 12. Outer section 22 extends from the outer border of cover 12 to eyelets 16 and interweaving drawstring 18.

The cover-tote apparatus 10 of the present invention is useful for activities such as suntanning, picnicking, and many other activities where people need a ground cover to sit or lay on to protect themselves from the underlying ground. A user engaged in an activity requiring a ground cover can position cover-tote apparatus 10 in a ground covering position by spreading cover 12 into an open position, as shown in FIG. 1. When cover-tote apparatus 10 is in the covering position, cover 12 has an underside that lays adjacent to and against the ground surface and an upperside that is protected from the soil or sand located beneath the cover's underside. The user can then sit or lie on the covered surface and also place articles such as books, towels, and suntan lotion on the covered surface without contacting the underlying ground surface. The eyelets 16 and drawstring 18 are designed to be relatively thin so that the user may comfortably sit or lay across cover 12.

Figure 2:
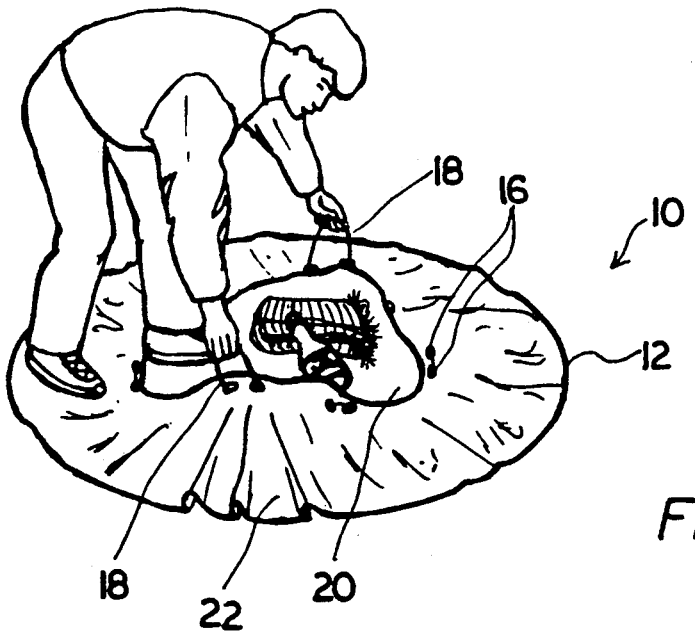
FIG. 2 is a perspective view of a user positioning the cover-tote apparatus of the present invention from a ground covering position to a tote position.
Figure 3:
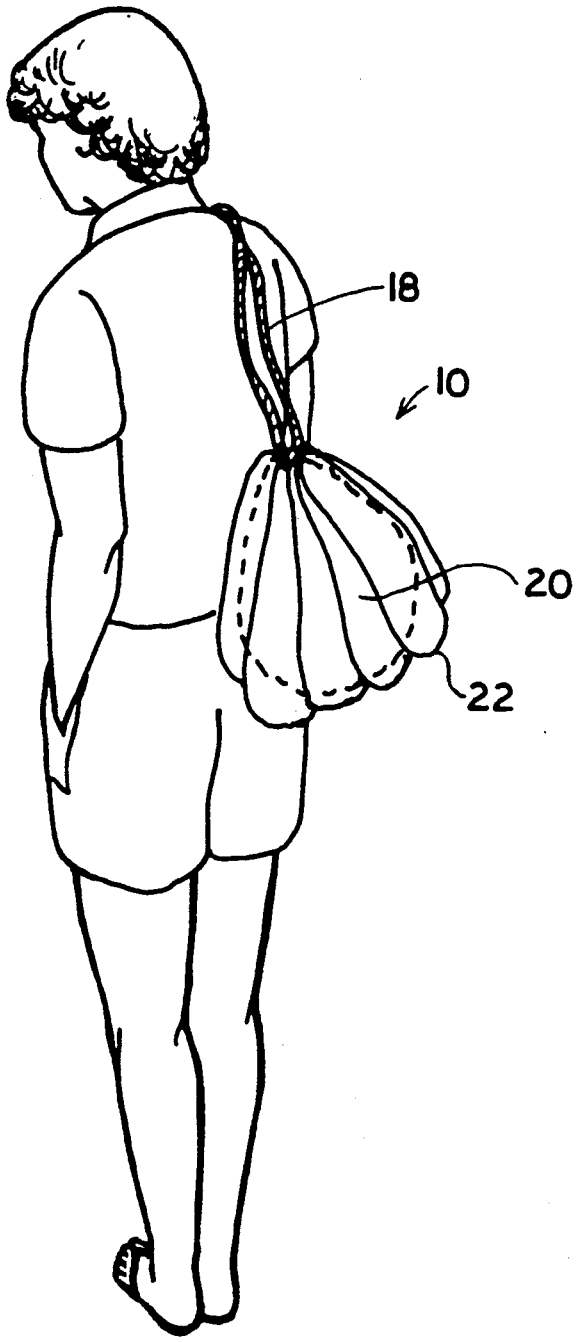
FIG. 3 is a perspective view of a user carrying the cover-tote apparatus in the tote position.

After use as a ground cover, cover-tote apparatus 10 can be converted into a tote position, shown in FIG. 3, for carrying articles that were used during the activity requiring a ground cover. Prior to converting cover-tote apparatus 10 from the covering position to the tote position, articles that will be carried by the cover-tote apparatus are gathered onto the upperside of cover 12 at the cover's center section 20. As shown in FIG. 2, these articles may include such items as towels and bottles of suntan lotion.

With the articles to be carried located in center section 20, a user grips drawstring 18 at pairs of eyelets 16 which are opposite each other and pulls upwardly on drawstring 18. Pulling drawstring 18 upwardly causes the outer border of center section 20, as defined by encircling drawstring 18 and eyelets 16, to draw together. Drawing together the outer border of center section 20 results in the center section 20 forming a bag 20 and in the outer section 22 forming a skirt 22 that extends over bag 20, as shown in FIG. 3. The user carries the cover-tote apparatus 10, which holds the articles placed on center section, by drawstring 18 which acts as a handle.

As previously described, eyelets 16 and interweaved drawstring 18 are located substantially inward from the outer border of cover 12. It is preferred that the eyelets 16 and drawstring 18 be located midway between the outer border and center of cover 12, such that the bottom of the skirt 22 is substantially aligned with the bottom of bag 20, but eyelets 16 and drawstring 18 can be located from one-third to four-fifths of the distance from the cover's center to the cover's outer border.

The strategic placement of the eyelets 16 and interweaved drawstring 18 substantially inward from the cover's outer border results in cover 12 being divided into a center section 20 that functions as a bag 20 and an outer section 22 that functions as a skirt 22. The design of a cover-tote apparatus 10 with strategically placed eyelets 16 and drawstring 18 that result in a bag 20 and a skirt 22 being formed as described above is advantageous for several reasons.

The strategic placement of the eyelets 16 and drawstring 18 on cover 12 does not impair the use of the cover-tote apparatus 10 as an ordinary ground cover. However, the strategic placement of the eyelets 16 and drawstring 18 is very beneficial when the cover-tote apparatus 10 is placed in the tote position. Because of the placement of eyelets 16 and drawstring 18, a bag 20 is formed from only the center section 20 of cover 12, and accordingly, the size of the bag 20 is limited. The formation of a smaller bag 20 results in the cover-tote apparatus 10 having a more manageable and less cumbersome size for the user to carry. Because of the relatively large dimensions needed for a cover designed for the user to sit or lie on, the prior art's placement of eyelets at a location that was not substantially inward from the border of the cover resulted in a bag being formed that was unwieldy and cumbersome to carry.

In addition, skirt 22 also provides a relatively clean protective barrier between the user carrying the cover-tote apparatus 10 and the bag 20 that the user is carrying. The formation of a barrier between the user and bag 20 is desirable because the exterior of the bag 20 is typically soiled due to the dual function of cover-tote apparatus 10. In particular, use of cover-tote apparatus 10 as a ground cover results in the underside of cover 12 being pressed against the ground and being soiled. As the user converts the cover-tote apparatus 10 into the tote position, the interior of bag 20 is formed from the side of cover 12 that functioned as the cover's upperside, while the bag's exterior side is formed from the side of the cover 12 that functioned as the cover's underside. Thus, the exterior of bag 20 will be soiled, while the interior of bag 20 will be relatively clean.

Similarly, one side of skirt 22 will be soiled when cover-tote apparatus 10 is used as a ground cover, while the other side of skirt 22 will remain relatively clean. However, the soiled side of skirt 22 folds down over the exterior of bag 20, while the relatively clean side is positioned adjacent to the user that carries bag 20. The skirt 22, therefore, helps prevent any soil or sand that adheres to the cover 12 when the cover-tote apparatus 10 is used as a ground cover from contacting the user carrying the cover-tote apparatus 10. Accordingly, skirt 22 has the dual function of limiting the size of bag 20 and providing a relatively clean protective layer that will prevent the person carrying the cover-tote apparatus 10 from contacting the soiled underside of cover 12.

A final advantage of cover-tote apparatus 10 is that the skirt 22 limits the amount of sand that will fall into bag 20 when cover-tote apparatus 10 is converted to the tote position. Sand that has fallen onto the upperside of cover 12 along the skirt 22 will not fall into the bag 22 when the cover-tote apparatus 10 is positioned to the tote position. Any sand or soil adhering to the outer side of skirt 22 is easily brushed off the skirt 22 and away from interior of bag 20.

The location of eyelets 16 and drawstring 18 may be varied on cover 12, in alternative embodiments, to adjust the size of the bag 20 in relation to skirt 22. In the preferred embodiment, the eyelets 16 and drawstring 18 are located midway between the center and outer border of cover 12 such that the skirt 22 extends completely over bag 20. However, in some designs of the cover-tote apparatus 10 it may be desirable to locate the eyelets 16 and drawstring 18 closer to the center of cover 12 such that a smaller bag 20 and a larger skirt 22 is formed. In other designs of cover-tote apparatus 10, it may be desirable to locate the eyelets 16 and drawstring 18 further away from the center of cover 12 such that a larger bag 20 and smaller skirt 22 is formed.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A pliable cover convertible from a ground cover or blanket to a tote bag and vice versa, the pliable cover comprising:

(a) a center section having a center point and a substantially circular outer boundary;

(b) a drawstring formed along the outer boundary of the center section intersection;

(c) an outer section extending from the outer boundary of the center section to a substantially circular outer cover edge wherein the outer cover edge is substantially evenly spaced from the boundary of the center section, and wherein the boundary of the center section is spaced at least substantially midway from the outer cover edge to the center point; and (d) the pliable convertible cover being transformable from the ground covering position to a tote position by gathering the draw string so as to form the center section into a bag having a side section and a bottom section and so as to form the cover's outer section into a skirt that depends downwardly from the drawstring to at least substantially the bottom section of the bag, wherein the skirt covers substantially all portions of the side section of the bag such that the skirt forms a protective barrier between a user carrying the bag and substantially all portions of the side section of the bag in order to prevent soil adhering to substantially any portion of the side section of the bag from coming into contact with a user carrying the bag.

2. The cover-tote apparatus of claim 1 wherein the cover is circular.

3. The cover-tote apparatus of claim 1 wherein the drawstring forms a carrying handle for the bag when the cover is in a tote position.

4. The cover-tote apparatus of claim 1 wherein the drawstring is formed along the outer edge portion of the center section by threading the drawstring through a plurality of eyelets that substantially encircle the center section.

5. The cover-tote apparatus of claim 1 further including a weighted element disposed along the cover's outer edge and substantially encircling the cover.

6. The cover-tote apparatus of claim 1 wherein the cover is circular.

7. The cover-tote apparatus of claim 1 wherein the drawstring forms a carrying handle for the bag when the cover is in a tote position.

* * * * *